US008973369B2

(12) United States Patent
Angel et al.

(10) Patent No.: US 8,973,369 B2
(45) Date of Patent: Mar. 10, 2015

(54) GAS-TURBINE BURNER HAVING INFLOW GUIDE MEANS

(71) Applicants: Robert Angel, Hobe Sound, FL (US); Drew Ehlert, Palm Beach Gardens, FL (US); Matthias Hase, Mülheim (DE); Michael Huth, Essen (DE); James Marshall, Lugoff, SC (US); Yevgeniy Shteyman, West Palm Beach, FL (US)

(72) Inventors: Robert Angel, Hobe Sound, FL (US); Drew Ehlert, Palm Beach Gardens, FL (US); Matthias Hase, Mülheim (DE); Michael Huth, Essen (DE); James Marshall, Lugoff, SC (US); Yevgeniy Shteyman, West Palm Beach, FL (US)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/715,233

(22) Filed: Dec. 14, 2012

(65) Prior Publication Data

US 2013/0269352 A1 Oct. 17, 2013

Related U.S. Application Data

(63) Continuation of application No. 12/668,121, filed as application No. PCT/EP2008/058491 on Jul. 2, 2008, now Pat. No. 8,387,394.

(60) Provisional application No. 60/958,822, filed on Jul. 9, 2007.

(51) Int. Cl.

| | |
|---|---|
| ***F02C 1/00*** | (2006.01) |
| ***F02G 3/00*** | (2006.01) |
| ***F23R 3/14*** | (2006.01) |
| ***F23R 3/28*** | (2006.01) |
| ***F23R 3/34*** | (2006.01) |

(52) U.S. Cl.

CPC . *F23R 3/14* (2013.01); *F23R 3/286* (2013.01); *F23R 3/343* (2013.01); *F23D 2900/00008* (2013.01); *F23D 2900/14701* (2013.01)

USPC ..... 60/748; 60/747; 60/746; 60/804

(58) Field of Classification Search

USPC ..... 60/737–748, 804

See application file for complete search history.

(56) References Cited

U.S. PATENT DOCUMENTS

| | | | | |
|---|---|---|---|---|
| 5,359,847 | A * | 11/1994 | Pillsbury et al. | 60/39.463 |
| 6,634,175 | B1 * | 10/2003 | Kawata et al. | 60/746 |
| 8,387,394 | B2 * | 3/2013 | Hase et al. | 60/748 |
| 2007/0199326 | A1 * | 8/2007 | Tanimura et al. | 60/740 |

* cited by examiner

*Primary Examiner* — Craig Kim

(57) ABSTRACT

A gas-turbine burner having a plurality of main swirl generators which each have an inlet flow opening formed by the main swirl generator edge is provided. In order to achieve a uniform flow of combustion air through the main swirl generator, the gas-turbine burner has an inlet-flow guide means with a flow guide surface which runs from one of the inlet-flow openings to an adjacent inlet-flow opening, to which the main swirl generator edges which form the inlet-flow openings are connected, and the flow guide surface widens from there radially upwards. The main swirl generators are central-symmetrically arranged around a pilot burner and the flow guide surface runs radially outside the main swirl generators.

7 Claims, 4 Drawing Sheets

GAS-TURBINE BURNER HAVING INFLOW GUIDE MEANS

CROSS REFERENCE TO RELATED APPLICATIONS

This application is a continuation of application Ser. No. 12/668,121 filed on Jan. 7, 2010 which is the US National Stage of International Application No. PCT/EP2008/058491, filed Jul. 2, 2008 and claims the benefit thereof. The International Application claims the benefits of U.S. provisional application No. 60/958,822 US filed Jul. 9, 2007, both of the applications are incorporated by reference herein in their entirety.

FIELD OF INVENTION

The invention relates to a gas-turbine burner having a plurality of main swirl generators which each have an inlet flow opening formed by the main swirl generator edge.

BACKGROUND OF INVENTION

In gas turbines combustion air is usually compressed in a multistage compressor and then guided to a number of gas-turbine burners which are arranged on a combustion tube typically guided in an annular shape around the turbine axis. In the effort to carry out combustion in a gas turbine while generating as little $NO_x$ as possible, so-called DLN (dry low NOR) systems have been proven. In such systems there are a number of main swirl generators, also referred to as the main swirl generator arranged around a pilot plug in each gas-turbine burner, in which fuel—usually natural gas—is swirled strongly with air to create a stable pilot flame. The compressed air flows through the main swirl generators and is mixed with the fuel in the main swirl generators, in order to burn downstream outside the main swirl generators in a combustion tube. The gas heated up by the combustion is subsequently directed into a working turbine to do work by expansion.

To keep a burner section of a gas turbine compact, the combustion air compressed in the compressor is usually guided to the gas-turbine burners located radially further outwards so that the compressed air is guided outwards against a direction of flow in the main swirl generators along the gas-turbine burner or their burner casings. To enable it to flow into the inlet flow openings of the main swirl generators, the flow of the compressed combustion air must undergo a reversal in its direction and in doing so flow around a deflection edge of the burner casing and/or of the main swirl generator facing away from the combustion tube.

The reversal of direction and the flow around a deflection edge can lead to a flowback occurring between the main swirl generators and the burner casing which may possibly even continue into small areas within the main swirl generators. A detaching of the flow at or from the deflection edge can lead to the same effect. This results in an uneven distribution of the flow through the main swirl generators, with the most problematic area—in relation to a radial inner pilot plug—being the radial outer zones of the main swirl generators. The uneven air mass flow and the lower flow speeds resulting therefrom in these problematic zones results during the injection of fuel into these zones in very rich mixtures, for which a high risk of flame flash back exists. The flowback zones, which are also always associated with a transient behavior, increase the tendency to thermo acoustic combustion chamber vibrations.

U.S. Pat. No. 4,689,961 describes combustion chamber equipment mt with swirl generators and also a cup-shaped bulge with a passage in which the injector and the swirl generator and also an inflow means are accommodated.

US 2003/0110774 A1 discloses a gas turbine with main flow generators having an inflow opening.

To solve this problem an attempt has been made to introduce increased combustion air within the main swirl generators in order to make the rich areas leaner. In a similar way only a small proportion of fuel was entered into the problem zones, which leads to a worse mixture and thereby to a higher $NO_x$ emission.

SUMMARY OF INVENTION

An object of the present invention is to specify a gas-turbine burner which exhibits an even air flow in the main swirl generators.

This object is achieved by a gas-turbine burner of the type mentioned at the start, which features an inflow guide means with a flow guide surface running from one of the inflow openings to an adjacent inflow opening, which is adjoined by the main swirl generator edges forming the inflow openings and which is widened out radially from there. The reversal in direction of the compressed combustion air before the inlet openings can be guided along the flow guide surface by the flow guide surface adjoining the inflow openings, so that the formation of swirling at this point is reduced. This allows vacuum zones which promote a flowback within the main swirl generators to be kept small. This leads to a more even distribution of the flow in the main swirl generator, so a flowback can be greatly reduced or even avoided. The more even inflow also achieves a greater flexibility for the pattern of the premix holes, less flushing air is needed and a loss of pressure in the main swirl generators and at the flow diversion is reduced.

The flow guide surface of the inflow guide means adjoins the main swirl generator edges of the main swirl generators forming the flow guide surface of the main swirl generators, with a direct impact at the main swirl generator edges not being necessary, but instead a small installation gap being able to remain for successive fitting of the main swirl generator and of the inflow guide means into the gas-turbine burner. The course of the inflow guide means from an inflow opening to the adjacent inflow opening, especially a continuous course, enables swirling of the combustion air between the main swirl generators to be counteracted. The radial widening out of the flow surfaces enables an area radially outside the main swirl generators to be blocked for reducing or avoiding eddies. The radial direction in this case is related to a center around which the main swirl generators are arranged radially.

Expediently the flow guide surface is curved in a convex shape in the direction of the combustion air flowing around it, so that the combustion air flowing back towards the inflow opening in an arc is guided along the curved flow guide surface.

Advantageously the flow guide surface adjoins the main swirl generator at the main swirl generator pipes in parallel to the course of the main swirl generator pipes. The parallel nature of the connection enables an abrupt change in direction in the air guidance at the edge between the flow guide surface and the main swirl generator pipe to be avoided. The connection in this case does not have to be at the outermost main swirl generator edge, but can also lie radially within the main swirl generator edge.

The main swirl generators are arranged central-symmetrically, especially around a pilot burner, and the flow guide surface runs radially outside the main swirl generators. A combustion air flow flowing from radially outside into the main swirl generators of the gas-turbine burner can be guided with little eddying in the critical area radially outside the main swirl generators. The central symmetry can be a circular symmetry, with the main swirl generators being arranged in a circular ring. Centrally-symmetrical polygon or rosette geometries are also conceivable for example.

In a further advantageous embodiment of the invention the flow guide surface exhibits a central symmetry at a radially outer area and deviates in an area lying further inwards radially from the central symmetry and is adapted to the form of the main swirl generator edges. This change of symmetry from the central symmetry to the symmetry of the individual main swirl generators or main swirl generator edges enables an at least low-swirl flow to be achieved around all main swirl generator edges.

The flow guide surface is expediently routed in a ring-shape, especially a circular ring shape continuously around the main swirl generators, which enables an even inflow to be achieved from all sides into the gas-turbine burner.

To achieve a low-swirl guidance of the combustion air in the area of the reversal in direction the flow guide surface is expediently arranged as a type of bead in the inflow direction in front of the main swirl generators. The bead can be formed in the shape of a U-bend with—relative to the direction of flow in the main swirl generators—limbs being arranged downstream.

In an advantageous embodiment of the invention the flow guide surface runs from a section facing radially outwards to a section facing radially inwards at the inflow opening. In this way the flow can be guided during a complete reversal of direction by the flow guide surface.

If the section facing outwards forms a central-symmetrical surface, especially an annular surface, and if the section facing inwards forms a surface adapted to the annular shape of the main swirl generator, a flow guided with little swirling can be achieved all around the main swirl generators.

Expediently the flow guide surface runs with at least an essentially even curvature from the outward-facing section to the inward-facing section. This enables the combustion air reversing its direction to be guided essentially completely from its direction flowing back radially outside the main swirl generators to its direction flowing forwards radially within the main swirl generators. The even curvature is produced here by a circular cut line between the flow guide surface and a plane aligned in the radial direction, with the radial direction relating to the center around which the main swirl generators are arranged. The even curvature does not have to be present in every plane in the radial direction. It is sufficient for it to be realized in a single plane aligned in the radial direction, for example in a plane running through the above-mentioned center and through between the main swirl generators. Expediently the curvature is even in each of the planes running through between the main swirl generators.

In a further advantageous embodiment of the invention the inflow guide means connects a burner casing running around the main swirl generators to the main swirl generators. A flow of the combustion air radially outside the gas-turbine burner along the burner casing means that the flow in this area is already low-swirl. Connecting the burner casing to the main swirl generator through the inflow means enables the freedom from swirl to be maintained at least essentially to the main swirl generators. In this case the connection advantageously exists to the main swirl generators or in the direct vicinity of the inflow opening.

An undesired flowback between the burner casing and the main swirl generators can be avoided if the inflow guide means closes off a gap between a burner casing running around the main swirl generators and the main swirl generators. In this case a small installation gap can remain between the burner casing and the main swirl generators, with a gap width of up to 2 mm for example.

Advantageously the flow guide surface is routed between the main swirl generators. In this way a gap between the main swirl generators or the main swirl generator edges can be closed at least partly.

The curvature of the flow guide surfaces from the section facing radially outwards to the section facing inwards is also even in the areas between the main swirl generators.

Advantageously the flow guide surface is guided to the radial depth of the main swirl generator axes of the main swirl generators between the main swirl generators. A gap between the main swirl generators can thus be closed off completely—if necessary except for the installation gap.

The inflow guide means and the main swirl generators can easily be made simple to install if the inflow guide means is guided radially outside past the main swirl generator edges in its radially inner section. Expediently it is aligned in the axial direction in the immediate vicinity of the main swirl generator edges, so that the main swirl generator or the inflow guide means can simply be pushed in the axial direction to install them.

It is also proposed that the gas-turbine burner features an outer and an inner burner casing, surrounding the main swirl generators in each case, which are respectively adjoined by the inflow guide means in the casing direction. In addition to a high level of stability, which is able to be achieved by such an embodiment of the inflow guide means, the combustion air can be guided along a large radius of curvature of the flow guide surface so that a large vacuum along this surrounding flow can be countered. The casing direction here is the direction of the casing at the point of the join and especially the axial direction of the gas turbine burner, so that the flow guide surface is aligned at the connection to at least the outer burner casing, expediently to both burner casings, in the axial direction.

If the inflow guide means has two arms pointing in the inflow direction, which on the downstream flow side of the inflow opening are especially routed together in parallel, a stable construction and ease of installation of the inflow guide means can be achieved.

To be able to guide the supports of the gas-turbine burner through the inflow guide means in a simple manner, with simple manufacturing and installation of the inflow guide means, the inflow guide means is expediently embodied in the area of the flow guide surface in a tangential direction in multiple parts.

BRIEF DESCRIPTION OF THE DRAWINGS

The invention will be explained in greater detail on the basis of exemplary embodiments which are shown in the drawings. The Figures show.

DETAILED DESCRIPTION OF INVENTION

Figure 1:
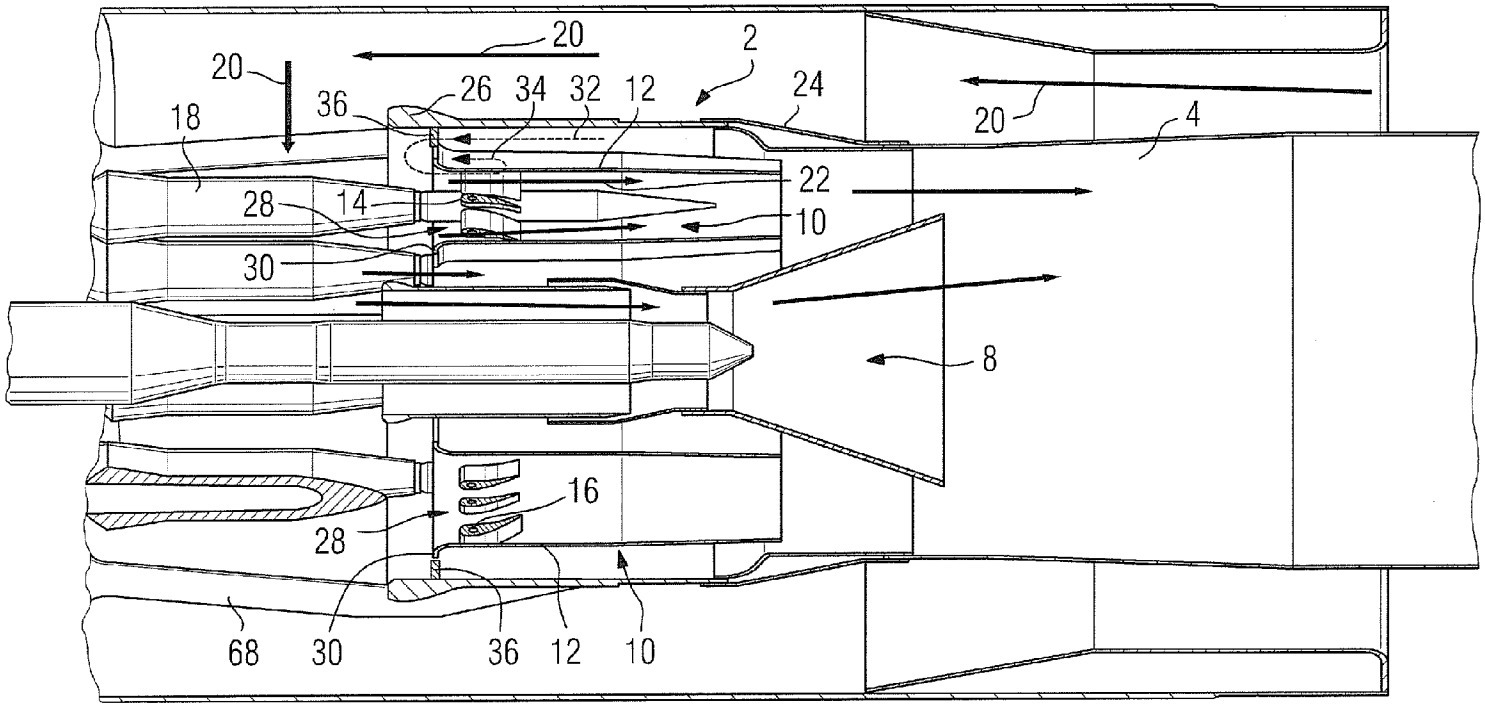
FIG. 1 a cross-sectional diagram through a gas-turbine burner with eight main swirl generators arranged around a central pilot plug, FIG. 2 a section through a slightly-modified gas-turbine burner with a slightly-modified inflow guide means, FIG. 3 a further bead-shaped inflow guide means in a perspective detailed view FIG. 4 the inflow guide means from FIG. 3 in an overall perspective view of the gas-turbine burner, FIG. 5. the inflow guide means in a longitudinal section and FIG. 6 an overhead view of a section of the inflow guide surface of the inflow guide means.

FIG. 1 shows a gas-turbine burner 2 in a longitudinal section with a combustion tube 4. The gas-turbine burner 2 comprises a pilot burner with a pilot plug 8, around which eight main swirl generators 10 are arranged in a ring. Each of the main swirl generators 10 has a main swirl generator pipe 12, within which is arranged a premixing blade 14 with a number of vanes oriented radially outwards. In each of the vanes run a premixing gas duct 16 carrying fuel, which is connected to premixing holes not shown in the figure, through which the fuel is pressed into the interior of the main swirl generator tube 12. The fuel is guided through feed inlets 18 to each main swirl generator 10 and mixed within the main swirl generator pipe 12 with compressed combustion air.

The course of a flow of the combustion air flowing around the gas-turbine burner 2 is shown by solid arrows 20 in the figure. The combustion air flows around the gas-turbine burner 2 initially against a direction of flow 22, which is related to the premixing flow within the main swirl generator 10. It flows along a burner casing 24 which surrounds all main swirl generators 10 of the gas-turbine burner 2 in order to then flow in an arc around an edge 26 of the burner casing 24 in the direction of an inlet opening 28 of each main swirl generator 10. The inlet flow opening 28 is surrounded by the main swirl generator edge 30 of the corresponding main swirl generator 10 facing away from the combustion tube 4.

The diversion of the flow of the combustion air produces a vacuum zone in the area of the section of the main swirl generator edge 30, which lies radially outwards in relation to the pilot plug 8, through which a suction and thereby a reverse flow 32 between the main swirl generator 10 and the burner casing 24 will be created, which is shown in the figure by a dashed-line arrow. This reverse flow 32 continues where necessary into a further reverse flow 34 within the main swirl generator 10, which ensures a small supply of air there and thus leads to a rich fuel mixture.

To counter the reverse flows 32, 34, the gas-turbine burner 2, in a simple embodiment of the invention, is equipped with an inflow guide means 36 which runs in an annular shape within the burner casing 24 around all main swirl generators 10 and essentially adjoins the main swirl generator edges 30 of the main swirl generator 10 in parallel. This enables the external reverse flow 32 to be at least largely eliminated, which also significantly reduces the inner reverse flow 34 and thus the flow through the main swirl generator 10 is evened out.

Figure 2:
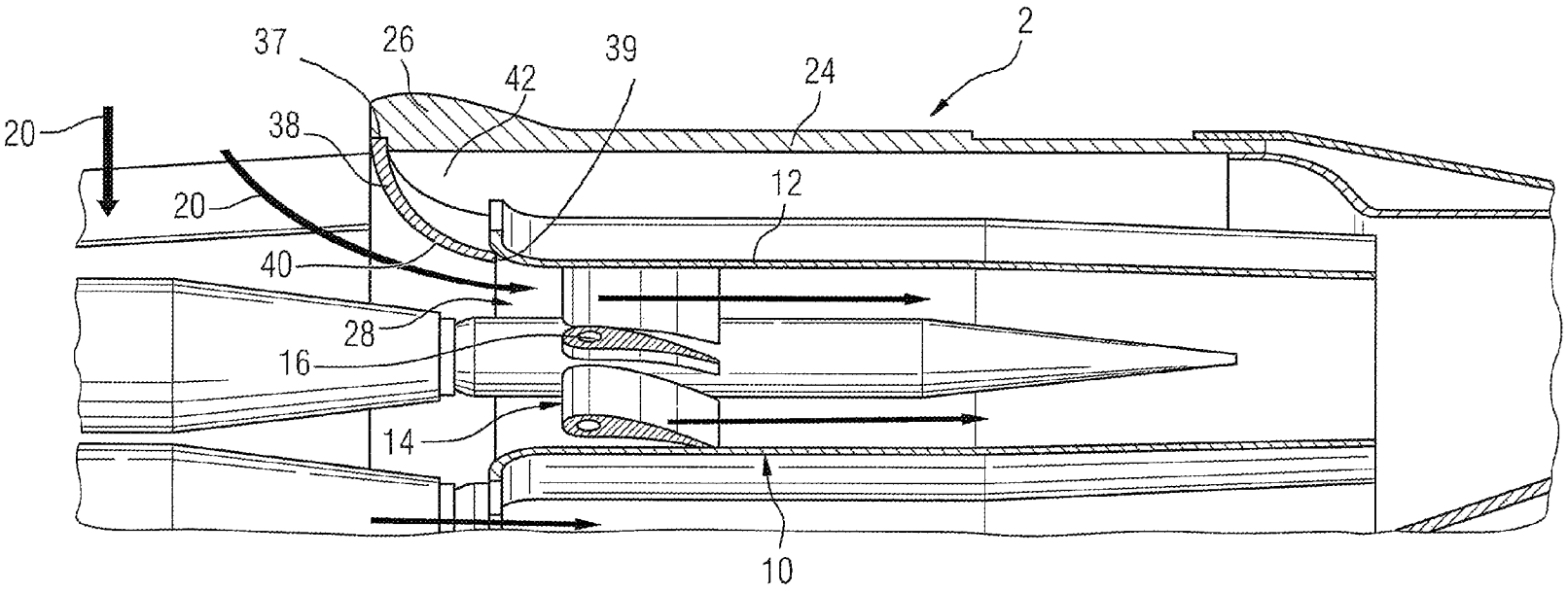

A more efficient embodiment of the invention is shown in FIG. 2. The subsequent description of the subsequent exemplary embodiments is essentially restricted to the differences from the embodiment described in FIG. 1, to which reference is made for features and functions that remain the same. Essentially components which remain the same are basically labeled with the same reference characters.

An inflow guide means 38 has a convex curved flow guide surface 40 which in the area of the inflow opening 28 essentially adjoins the main swirl generator pipe 12 in parallel. The flow guide surface 40 widens radially outwards and adjoins the burner casing 24 in order to connect the main swirl generator 10 with the burner casing 24 in this way. The inflow guide surface 40 is also curved so that it is aligned radially in the area of the burner casing 24 and is essentially aligned axially at the inflow opening 28. In addition the inflow guide means 38 closes off a gap 42 between the main swirl generators 10 and the burner casing 24 and for this purpose—as explained in detail for the exemplary embodiment from FIGS. 3 to 6—is guided between the main swirl generators 10 or between their main swirl generator edges 30. For easier installation however a small gap can remain between the inflow guide means 28 and the main swirl generator pipe 12.

Figure 3:
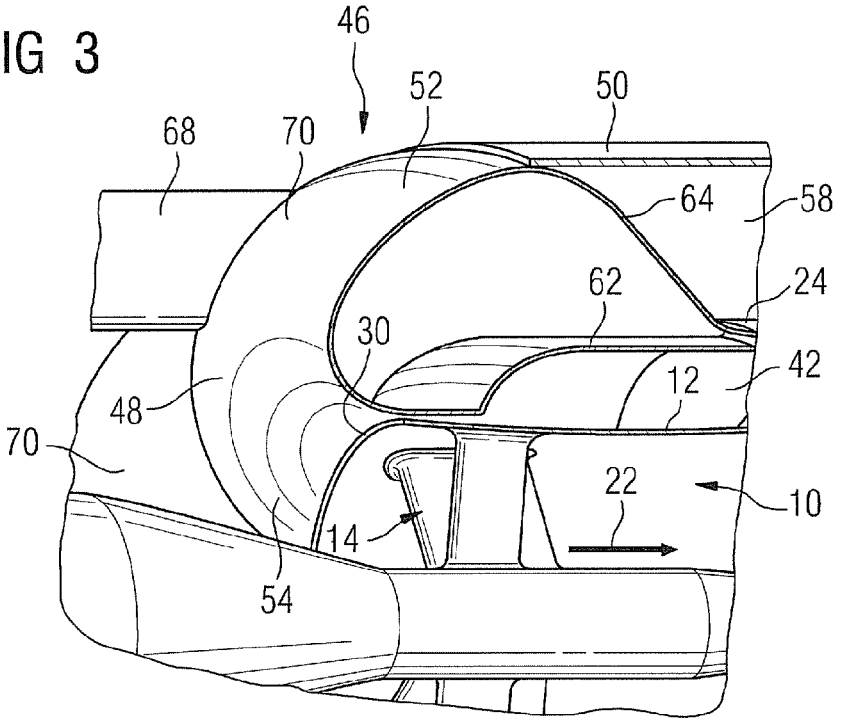
Figure 4:
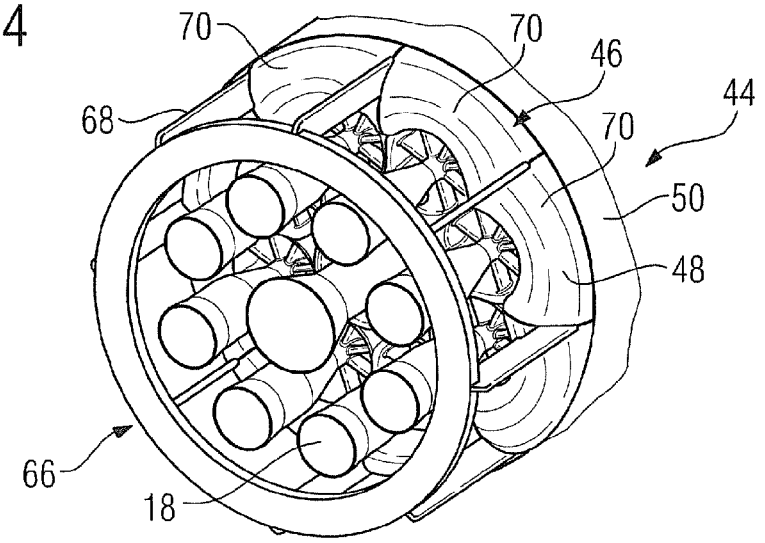
Figure 5:
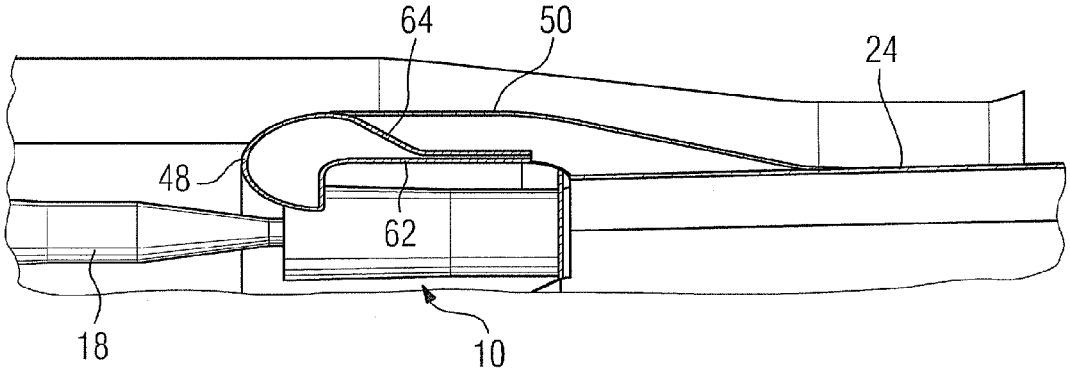
Figure 6:
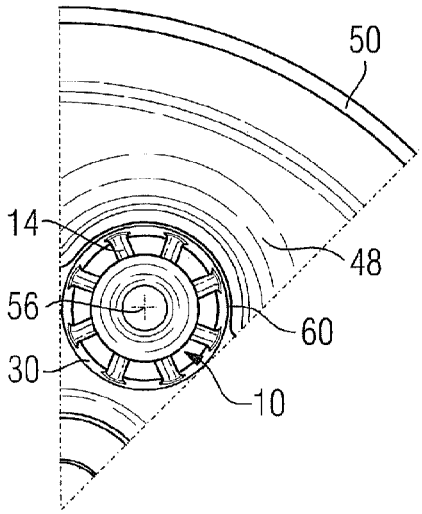

In FIGS. 3 to 6 a further gas-turbine burner 44 is shown with a very efficient inflow guide means 46. FIG. 4 shows a perspective overhead view of the gas-turbine burner 44 and the inflow guide means 46, FIGS. 3 and 5 show the inflow guide means in a section executed in an axial direction of the gas-turbine burners 44, and FIG. 6 shows a section of the inflow guide means 46 in an overhead view in the axial direction or the direction of flow 22 respectively.

The inflow guide means 46 has a bead-like flow guide surface 48 arranged in the inflow direction 22 in front of the main swirl generators 10, which connects the main swirl generator edges 30 of the main swirl generators 10 with an outer burner casing 50 which likewise surrounds the main swirl generators 10. The radial outer burner casing 50 serves to guide the combustion air a little outside the inner burner casing 24 in order to create a curvature of the flow deflection that is not too tight. The connection of the flow guide surface 48 to the outer burner casing 50 running in the axial direction is in the direction of the casing or in the axial direction respectively, so that a flow guidance from the outer burner casing 50 essentially passes seamlessly into the flow guide surface 48. In the subsequent passage of the flow the compressor air will be guided without any swirl to the inflow opening 28 from a section 52 facing radially outwards to a section 54 facing inwards which ends at the inflow opening 28, by the flow guide surface 48 embodied in this passage of flow with an essentially even curvature.

The inflow guide means 46 in this case, as is shown in FIG. 4, is guided in an annular shape around all main swirl generators 10 and engages radially inwards between the main swirl generators 10 or their main swirl generator edges 30 in order to close off both a gap 58 between the outer burner casing 50 and the main swirl generator pipe 12 and also the gap 42 between the inner burner casing 24 and the main swirl generator pipe 12. A reverse flow of combustion air through this gap 42, 58 to the inflow opening 28 will thus be at least largely avoided, with a smaller installation gap 60 between the main swirl generator pipe 12 and the inflow guide means 46 able to remain.

As can be seen in FIGS. 3, 4 and 6, the flow guide surface 48 is drawn radially inwards between the main swirl generators 10, and this is done to the height of the main swirl generator axes 56 of the main swirl generators 10 in order to suppress a flow of combustion air between the main swirl generators 10.

For easier installation the inflow guide means 46 is routed with its radial inner section 54 radially outside past the main swirl generator edges 30 and runs in the axial direction there, so that the main swirl generator 10 can be inserted in the axial direction for installation into the gas-turbine burner 44. Similarly the radial outer section 52 is routed radially within the outer burner casing 52 and likewise in the casing direction or the axial direction there, so that the inflow guide means 46 can be inserted into the burner casing 50. In its further course the inflow guide means 46 comprises an inner limb 62 and an outer limb 64, which are joined together in the direction of flow 22 at the inner burner casing 24 in parallel and attached to the burner casing 24.

To attach the gas-turbine burner 44 in a gas turbine the gas-turbine burner 44 comprises a holder 66 with holder elements 68 which are routed through the flow guide surface 48 and attached to the burner casings 24, 50. For simple manufacturing and assembly of the inflow guide means 46 it is divided up into a number of segments 70 between which a holder element 68 is routed through in each case.

We claim:

1. A gas-turbine burner, comprising:

a plurality of main swirl generators, each main swirl generator featuring an inflow opening formed by a main swirl generator edge; and an inflow guide means having a flow guide surface running from one of the inflow openings to an adjacent inflow opening, the flow guide surface extends from and is adjoined by a plurality of main swirl generator edges forming the plurality of inflow openings and extends to a burner casing and radially widens out from the main swirl generator edge, wherein the plurality of main swirl generators are arranged central-symmetrically around a pilot burner, and wherein the flow guide surface runs radially outside the plurality of main swirl generators, and wherein the flow guide surface extends from a first section facing radially outwards to a second section facing radially inwards lying at the inflow opening, wherein the inflow guide means connects the burner casing running around the plurality of main swirl generators to the plurality of main swirl generators, and wherein the inflow guide means closes off a gap between the burner casing running around the plurality of main swirl generators and the plurality of main swirl generators by adjoining the burner casing on a first end and adjoining a main swirl tube on a second end.

2. The gas-turbine burner as claimed in claim 1, wherein the first section forms a central-symmetrical surface and the second section has a surface adapted to the annular shape of the plurality of main swirl generators.

3. The gas-turbine burner as claimed in claim 1, wherein the flow guide surface has an essentially even curvature extending from the first section to the second section.

4. The gas-turbine burner as claimed in claim 1, wherein a radially inner section of the inflow guide means is routed radially outside of the plurality of main swirl generator edges.

5. The gas-turbine burner as claimed in claim 1, wherein an outer and inner burner casing each surround the plurality of main swirl generators, and wherein the outer and inner burner casing are each adjoined by the inflow guide means in a casing direction.

6. The gas-turbine burner as claimed in claim 1, wherein the inflow guide means includes two arms, an inner limb and an outer limb, pointing in the flow direction, and wherein the two arms are routed in parallel on a downstream side of the inflow opening.

7. The gas-turbine burner as claimed in claim 1, further comprising a holder including a plurality of holder elements, wherein the holder is used to attach the gas-turbine burner in a gas turbine, and wherein the plurality of holder elements are routed through the flow guide surface and attached to the burner casing.

* * * * *